US011251566B2

(12) United States Patent
Akagi

(10) Patent No.: US 11,251,566 B2
(45) Date of Patent: Feb. 15, 2022

(54) LEVER-TYPE CONNECTOR

(71) Applicant: Yazaki Corporation, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/925,721

(22) Filed: Jul. 10, 2020

(65) Prior Publication Data

US 2021/0013675 A1 Jan. 14, 2021

(30) Foreign Application Priority Data

Jul. 12, 2019 (JP) ..... JP2019-129747

(51) Int. Cl.
*H01R 13/62* (2006.01)
*H01R 13/629* (2006.01)

(52) U.S. Cl.
CPC . *H01R 13/62955* (2013.01); *H01R 13/62938* (2013.01)

(58) Field of Classification Search
None
See application file for complete search history.

(56) References Cited

U.S. PATENT DOCUMENTS

| | | | | |
|---|---|---|---|---|
| 6,602,082 | B2 * | 8/2003 | Nishide | H01R 13/62938 439/157 |
| 9,461,395 | B2 * | 10/2016 | Kataoka | H01R 13/62955 |
| 2017/0346225 | A1 | 11/2017 | Kanda et al. | |
| 2019/0074633 | A1 | 3/2019 | Ogashira | |

FOREIGN PATENT DOCUMENTS

| | | | |
|---|---|---|---|
| DE | 102017208784 | A1 | 11/2017 |
| JP | H06-011272 | U | 7/1994 |
| JP | 2003-100382 | A | 4/2003 |
| JP | 2016-126841 | A | 7/2016 |
| JP | 2017-168391 | A | 9/2017 |
| JP | 2017-216057 | A | 12/2021 |
| WO | 2004/093260 | A1 | 10/2004 |

* cited by examiner

*Primary Examiner* — Ross N Gushi
(74) *Attorney, Agent, or Firm* — Sughrue Mion, PLLC

(57) ABSTRACT

A lever-type connector includes a mating housing, a housing that is fitted into and removed from the mating housing, and a lever that is rotatably supported by the housing and fits the housings to each other. The lever includes a temporary locking arm portion that has a temporary locking portion, the housing includes a temporarily locked portion that is temporarily locked to and unlocked from the temporary locking portion of the temporary locking arm portion, the mating housing includes a release rib portion that releases a temporary locking state of the temporary locking portion of the temporary locking arm portion and the temporarily locked portion of the housing, and a cam groove of the lever includes a boss receiving portion that receives the cam boss when the mating housing and the housing are temporarily set.

4 Claims, 6 Drawing Sheets

LEVER-TYPE CONNECTOR

CROSS-REFERENCE TO RELATED APPLICATIONS

The present application is based on, and claims priority from Japanese Patent Application No. 2019-129747, filed on Jul. 12, 2019, the entire contents of which are incorporated herein by reference.

TECHNICAL FIELD

The present application relates to a lever-type connector in which connectors can be fitted to each other with low insertion force due to rotation of a lever.

BACKGROUND

JP 2017-168391 A discloses this type of lever-type connector. This lever-type connector includes a housing having a fitting cylindrical portion that is fitted into and removed from a hood portion of a mating housing. In addition, the lever-type connector includes a lever. The lever is rotatably supported, via bearings, by support shafts on both sides of the fitting cylindrical portion of the housing, and has a cam groove that engages with a cam follower arranged in the hood portion of the mating housing. By rotating the operating portion, the cam groove is engaged with the cam follower and thus the housings are fitted to each other. A shaft center of the cam follower in the mating housing, the cam follower being engaged with the cam groove of the lever, is shifted in position toward the operating portion, which is upward of a shaft center of the bearing of the lever in a vertical direction (direction orthogonal to fitting direction of housing and mating housing).

In the lever-type connector, the cam follower of the mating housing abuts against a gentle slope of the cam groove of the lever. Therefore, when the mating housing is pushed further into the housing from a temporary set state of both housings, the lever may rotate, and a female terminal of the housing and a male terminal of the mating housing may be fitted into a position where these terminals can be electrically conducted.

SUMMARY

The present application has been achieved in order to solve the above problems, and an object of the application is to provide a lever-type connector that can prevent rotation of a lever when both housings are temporarily set, and that can prevent electrical conduction between terminals of the housings before the lever is operated.

A lever-type connector according to a first aspect of the present application includes a mating housing having a cam boss, a housing that is fitted into and removed from the mating housing, and a lever that is rotatably supported by the housing via a support shaft, has a cam groove engaging with the cam boss, and is rotated from a temporary locking position to cause the cam groove to engage with the cam boss, thus moving the mating housing toward the housing and fitting the mating housing and the housing to each other. The lever includes a temporary locking arm portion that has a temporary locking portion and is elastically deformable, and the housing includes a temporarily locked portion that is temporarily locked to and unlocked from the temporary locking portion of the temporary locking arm portion. Further, the mating housing includes a release rib portion that releases a temporary locking state of the temporary locking portion of the temporary locking arm portion and the temporarily locked portion of the housing, and the cam groove of the lever includes a boss receiving portion that receives the cam boss when the temporary locking state of the temporary locking portion of the temporary locking arm portion and the temporarily locked portion of the housing is released in a state where the mating housing and the housing are temporarily set.

A lever-type connector according to a second aspect of the present application relates to the lever-type connector according to the first aspect. A projecting temporary set beak portion is formed on a lower surface of the release rib portion, and the housing includes a temporary set arm portion that prevents the mating housing from being removed from the housing, the mating housing and the housing being in a temporary set state when a temporary locking state of the temporary locking portion of the temporary locking arm portion of the lever and the temporarily locked portion of the housing is released. In addition, a distal end of the temporary set arm portion includes a projection that slides along the lower surface of the release rib portion, and the temporary locking state of the temporary locking portion of the temporary locking arm portion of the lever and the temporarily locked portion of the housing is released at a position where the projection is across the temporary set beak portion from the lower surface of the release rib portion.

With the configuration described above, it is possible to provide a lever-type connector that can prevent the rotation of the lever when the mating housing and the housing are temporarily set, and that can prevent electrical conduction between terminals of the housings before the lever is operated.

DETAILED DESCRIPTION

Figure 1:
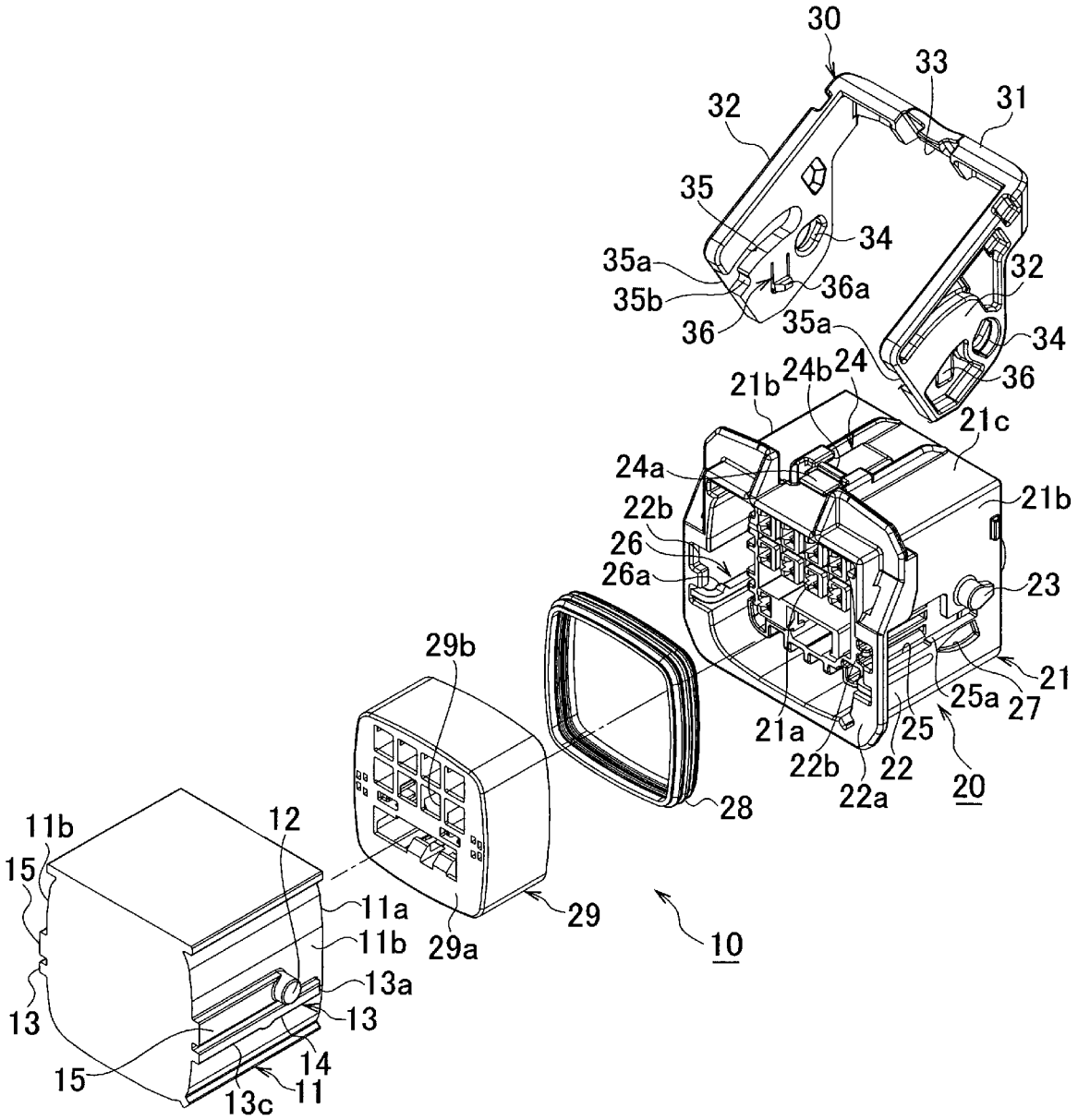
FIG. 1 is an exploded perspective view illustrating an example of a lever-type connector according to the present embodiment.

Hereinafter, a lever-type connector according to the present embodiment will be described in detail with reference to the drawings. Note that the dimensional ratios in the drawings are exaggerated for convenience of explanation, and may differ from the actual ratios.

As illustrated in FIG. 1, a lever-type connector 10 includes a male housing (mating housing) 11 that is made of synthetic resin and has a cam boss 12, a female housing (housing) 20 that is made of synthetic resin and is fitted into and removed from the male housing 11, and a lever 30 made of synthetic resin. The lever 30 is rotatably supported by a support shaft 23 arranged in the female housing 20, and has a cam groove 35 that engages with the cam boss 12 of the male housing 11. By rotating an operating portion 31 of the lever 30, the cam groove 35 is engaged with the cam boss 12 and thus the male housing 11 is made to move toward the female housing 20, so that the male housing 11 and the female housing 20 are fitted to each other. In FIG. 1, the direction in which the male housing 11 and the female housing 20 are fitted to each other is referred to as "fitting direction", the direction orthogonal to the fitting direction, in which the cam bosses 12 formed on both side surfaces 11*b*, 11*b* of the male housing 11 are connected, is referred to as "width direction", and the vertical direction in the figure orthogonal to the fitting direction and the width direction, in which an upper surface 21*c* and a bottom surface of the female housing 20 are connected, is referred to as "height direction". Note that the directions such as "longitudinal" and "vertical" are defined for convenience of explanation, and do not limit the actual mounting orientations of the respective elements.

Figure 2:
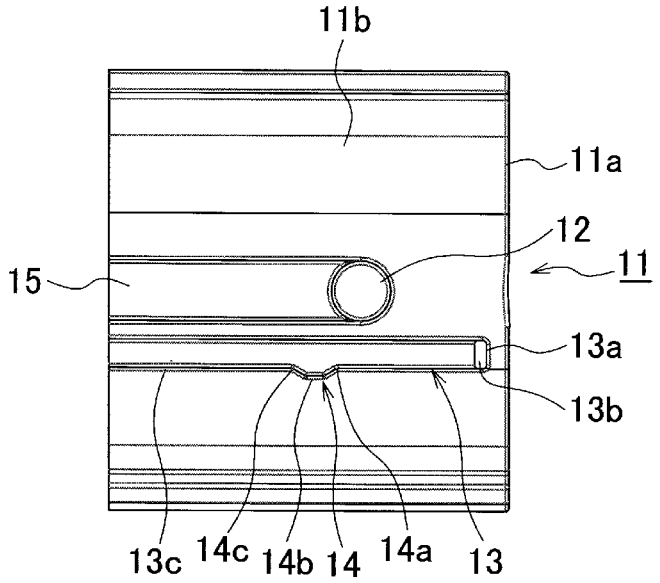
FIG. 2 is a side view of a male housing of the lever-type connector.

As illustrated in FIGS. 1 and 2, the male housing 11 has, on the front side (one fitting-direction side), a hood portion 11*a* that is inserted into a hood portion 22 of the female housing 20. The cylindrical cam boss 12 is integrally formed in a projecting manner at a center in the height direction of each of the side surfaces 11*b*, 11*b* of the male housing 11 in the width direction. A release rib portion 13 extending in the longitudinal direction (fitting direction) is integrally formed in a projecting manner under (on one height-direction side of) the cam boss 12 on each of the side surfaces 11*b*, 11*b* of the male housing 11. A distal end 13*a* of the release rib portion 13 on one fitting-direction side functions as a release portion that releases a temporary locking state of a cutaway portion (temporarily locked portion) 25 of the female housing 20 and a temporary locking projection (temporary locking portion) 36*a* of a temporary locking arm portion 36 of the lever 30, which will be described later. A trapezoidal temporary set beak portion 14 is integrally formed in a projecting manner at a center in the fitting direction of a lower surface 13*c* of the release rib portion 13 in the height direction. As illustrated in FIG. 2, a slope 13*b* is formed on the back side (other fitting-direction side) of the distal end 13*a* of the release rib portion 13. The trapezoidal temporary set beak portion 14 has a front slope 14*a* on one fitting-direction side, a straight surface 14*b*, and a back slope 14*c* on the other fitting-direction side. In the hood portion 11*a* of the male housing 11, a tab portion of a male terminal (terminal), which is not illustrated, is exposed.

As illustrated in FIG. 1, the female housing 20 includes a block-like housing main body 21 having a plurality of terminal accommodating chambers 21*a*, and the hood portion 22 that is integrally formed in a projecting manner on the front side (other fitting-direction side) of the housing main body 21 and into which the hood portion Ila of the male housing 11 is fitted. The support shaft 23 is integrally formed in a projecting manner at a center in the height direction of each of side surfaces 21*b*, 21*b* of the housing main body 21 in the width direction. An elastically deformable locking arm portion 24 is integrally formed in a projecting manner on the front side (other fitting-direction side) at a center in the width direction of the upper surface 21*c* of the housing main body 21 in the height direction. A receiving portion 24*b* is integrally formed in a projecting manner at a free end (distal end) 24*a* of the locking arm portion 24.

Figure 3:
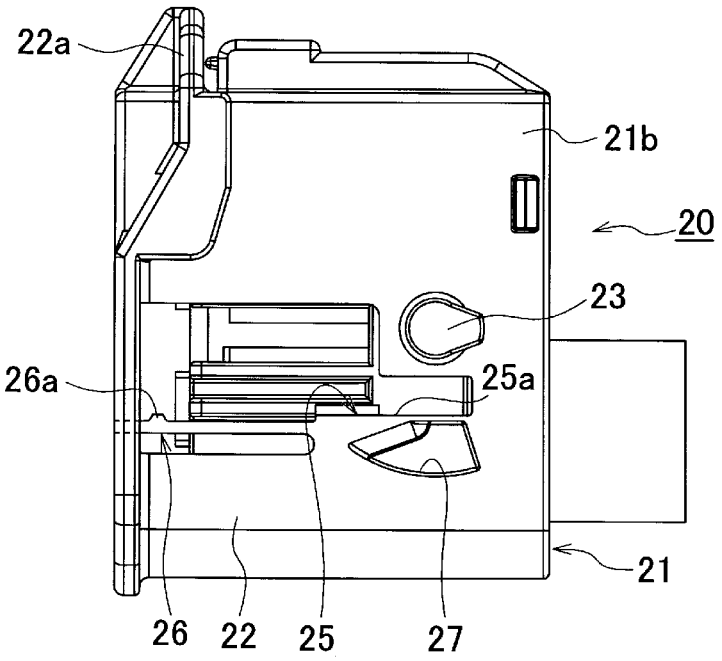
FIG. 3 is a side view of a female housing of the lever-type connector.

As illustrated in FIGS. 1 and 3, the substantially rectangular cutaway portion (temporarily locked portion) 25 is formed on the front side (other fitting-direction side) at a center in the height direction of each of side portions of the hood portion 22 of the female housing 20 in the width direction. That is, the temporary locking projection 36*a* of the temporary locking arm portion 36 of the lever 30 to be described later is temporarily locked to or unlocked from a lower edge 25*a* of each cutaway portion 25 in the height direction. When the temporary locking projection 36*a* of the temporary locking arm portion 36 is temporarily locked to the lower edge 25*a* of the cutaway portion 25, the lever 30 is held at a temporary lock position.

As illustrated in FIGS. 1 and 3, a double-supported temporary set arm portion 26 is integrally formed to be elastically deformable on the front side (other fitting-direction side) of the lower edge 25*a* of each cutaway portion 25. A projection 26*a* is formed on an upper surface (other height-direction side) closer to the front side (other fitting-direction side) of the temporary set arm portion 26. The projection 26*a* slides along the lower surface 13*c* of the release rib portion 13. The temporary set arm portion 26 functions to prevent the male housing 11 from being removed from the female housing 20, the male housing 11 and the female housing 20 being in a temporary set state when the lever 30 is unlocked from the temporary locking position, until the projection 26*a* slides along the lower surface 13*c* of the release rib portion 13 and reaches a position across the temporary set beak portion 14.

As illustrated in FIG. 1, a rectangular cylindrical front holder 29 that is made of synthetic resin and has a front wall portion 29*a* is fitted to the periphery of a plurality of the terminal accommodating chambers 21*a* of the housing main body 21 in the hood portion 22 of the female housing 20. A rectangular annular packing 28 made of rubber is interposed between the hood portion 22 of the female housing 20 and the periphery of the terminal accommodating chambers 21*a* of the housing main body 21. The front wall portion 29*a* of the front holder 29 includes a plurality of rectangular openings 29*b* communicating with the plurality of terminal accommodating chambers 21*a* of the housing main body 21. A female terminal (not illustrated) is accommodated in the terminal accommodating chamber 21*a* of the housing main body 21. The female terminal accommodated in the terminal accommodating chamber 21*a* of the housing main body 21 is held by a lance (not illustrated) arranged in the terminal accommodating chamber 21*a*.

Figure 4A:
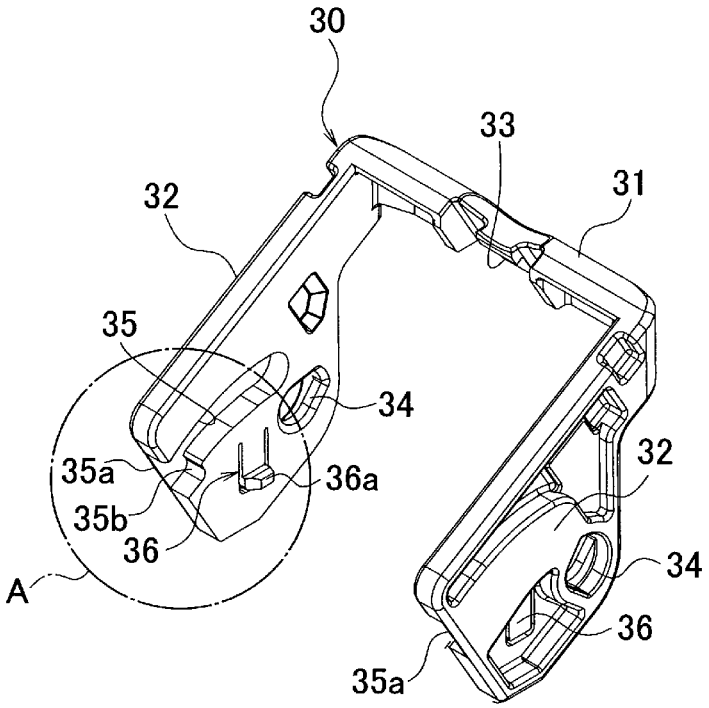
FIG. 4A is a perspective view of a lever of the lever-type connector.
Figure 4B:
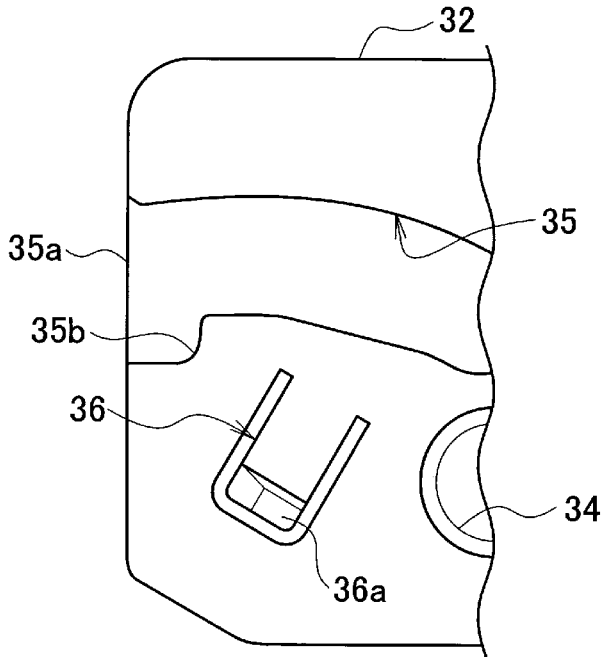
FIG. 4B is an enlarged side view of a part A in FIG. 4A.

As illustrated in FIGS. 1 and 4A, the lever 30 includes the operating portion 31 and a pair of arm portions 32, 32 extending from both sides of the operating portion 31 in the width direction.

As illustrated in FIGS. 1 and 4A, a locking projection 33 is formed on the lower side (one height-direction side) at a center in the width direction of the operating portion 31 of the lever 30. When the lever 30 is rotated to a rotation completion position, the locking projection 33 is locked to the receiving portion 24*b* of the locking arm portion 24 in the female housing 20. This locking brings about a rotation restricting state where the rotation of the lever 30 is restricted. The lock state of the locking projection 33 of the lever 30 and the receiving portion 24*b* of the locking arm portion 24 in the female housing 20 is released by pressing the side of the free end 24*a* of the locking arm portion 24 downward (one height-direction side) so as to detach the receiving portion 24*b* of the locking arm portion 24 from the locking projection 33.

As illustrated in FIGS. 1 and 4A, a bearing hole 34 that is rotatably supported by the support shaft 23 is formed on the back side (one fitting-direction side) of each arm portion 32 of the lever 30. The arcuate recessed cam groove 35 is formed in each of the inner sides of the arm portions 32 (sides at which arm portions 32 face to each other in width direction). The temporary locking arm portion 36 that is elastically deformable and has the temporary locking projection (temporary locking portion) 36*a* at its distal end is integrally formed on each of the lower sides (one height-direction side) of the arm portions 32. The temporary locking state of the temporary locking projection 36*a* of the temporary locking arm portion 36 in the lever 30 and the lower edge 25*a* of the cutaway portion 25 in the female housing 20 is released by the distal end 13*a* of the release rib portion 13 in the male housing 11. It is configured that immediately after the temporary locking state is released by the distal end 13*a* (after temporary locking state is released or at the same time when temporary locking state is released), the projection 26*a* of the temporary set arm portion 26 in the female housing 20 is moved across the temporary set beak portion 14 of the release rib portion 13 in the male housing 11. That is, at the position where the projection 26*a* of the temporary set arm portion 26 in the female housing 20 is moved across the back slope 14*c* of the temporary set beak portion 14 in the male housing 11 to abut against the lower surface 13*c* of the release rib portion 13, the temporary locking state of the temporary locking projection 36*a* of the temporary locking arm portion 36 in the lever 30 and the lower edge 25*a* of the cutaway portion 25 in the female housing 20 is completely released by the distal end 13*a* of the release rib portion 13 in the male housing 11.

As illustrated in FIGS. 4A, 4B, 7, and 9, the cam groove 35 of the arm portion 32 in the lever 30 includes a boss receiving portion 35*b* that receives the cam boss 12 of the male housing 11. The boss receiving portion 35*b* is formed by cutting, in an L shape, the lower side (one height-direction side) of the cam groove 35 closer to an entrance 35*a* of the cam boss 12. The boss receiving portion 35*b* functions when the temporary locking state of the temporary locking projection 36*a* of the temporary locking arm portion 36 and the cutaway portion 25 of the female housing 20 is released in a state where the male housing 11 and the female housing 20 are temporarily set.

Figure 5:
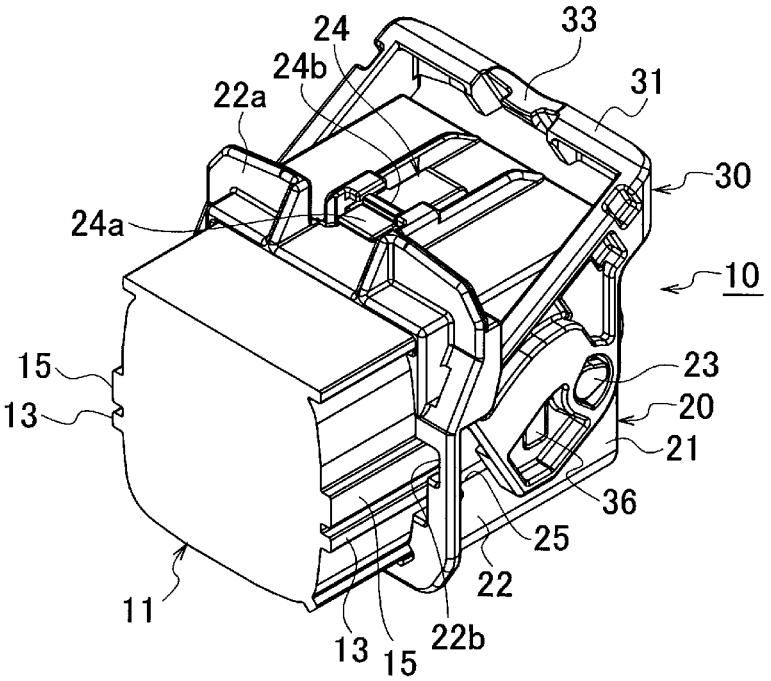
FIG. 5 is a perspective view illustrating a state before the male housing and the female housing are temporarily set.
Figure 6:
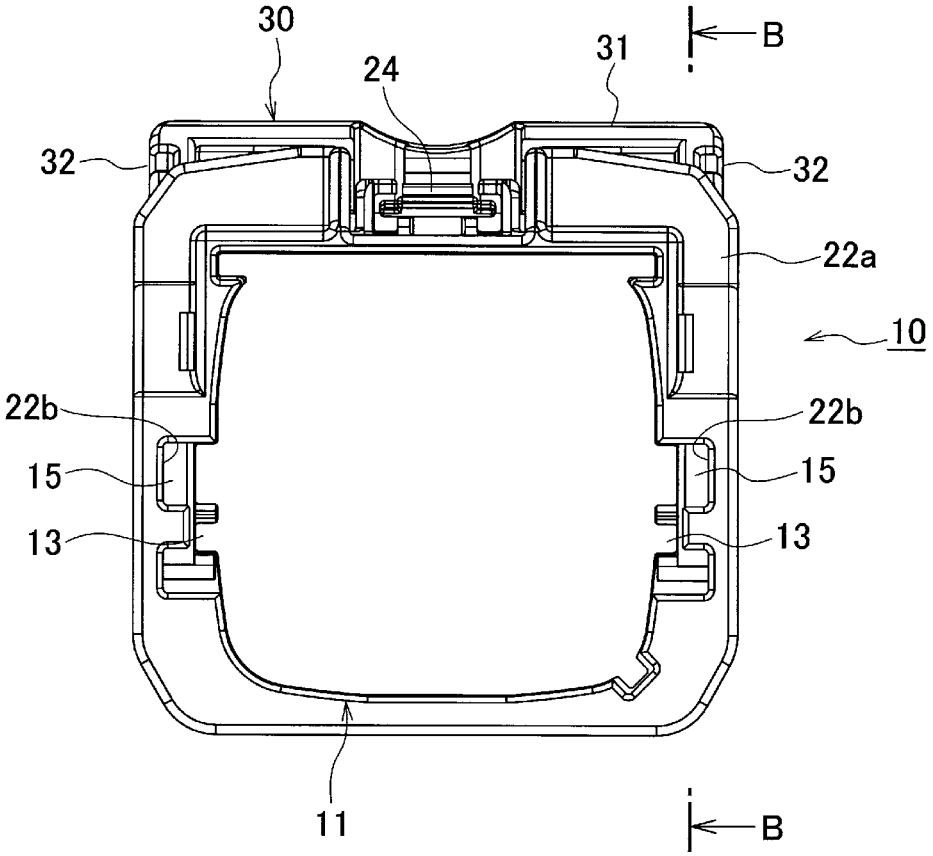
FIG. 6 is a front view of the lever-type connector before the temporary setting.

As illustrated in FIGS. 1 and 6, a protrusion 15 parallel to the release rib portion 13 in the fitting direction is integrally formed in a projecting manner on the back side (on other fitting-direction side of) of the cam boss 12 on each of the side surfaces 11*b*, 11*b* of the male housing 11. As illustrated in FIG. 5, when the male housing 11 is inserted into the hood portion 22 of the female housing 20, the protrusion 15 of the male housing 11 is accommodated and guided in a recess 22*b* on each of both sides of a flange portion 22*a* of the hood portion 22 in the female housing 20. When the lever 30 is rotated from a temporary locking position to a rotation completion position, the locking projection 33 of the lever 30 is locked to the receiving portion 24*b* of the locking arm portion 24 in the female housing 20 and maintained in a rotation restricting state. At this time, the temporary locking projection 36*a* of the temporary locking arm portion 36 formed on the arm portion 32 of the lever 30 is moved to a hole 27 formed from the lower edge 25*a* of the cutaway portion 25 made on each of both sides of the hood portion 22 in the female housing 20 downward (toward one height-direction side) of the cutaway portion 25, and then is accommodated in the hole 27.

Figure 7:
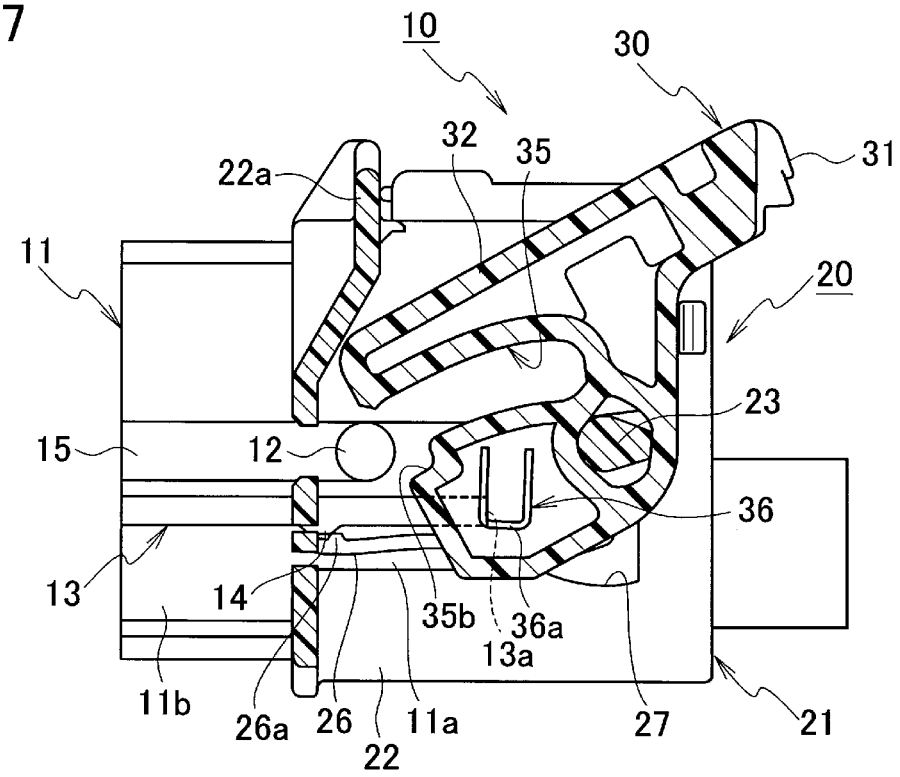
FIG. 7 is a sectional view taken along a line B-B in FIG. 6.
Figure 8:
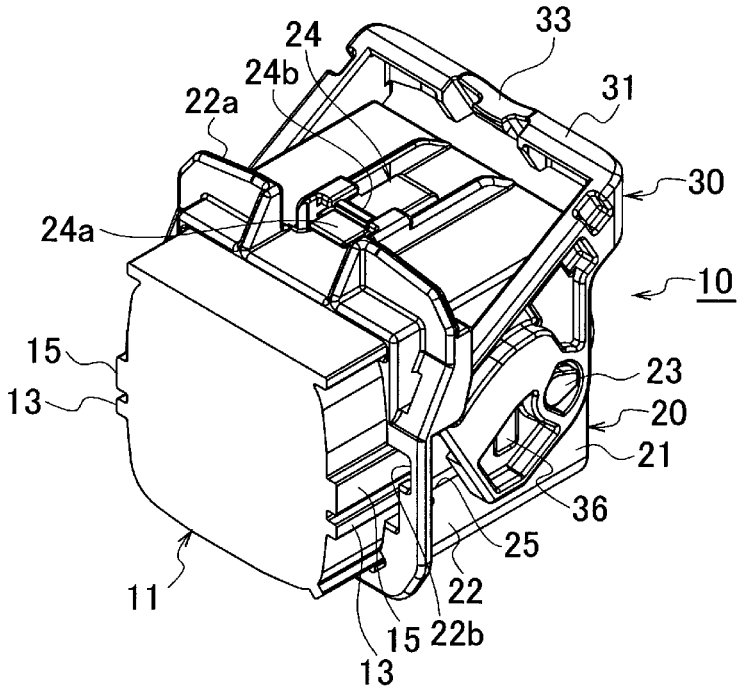
FIG. 8 is a perspective view illustrating a state after the male housing and the female housing are temporarily set.

As described above, according to the lever-type connector 10 of the embodiment, as illustrated in FIGS. 5 to 7, when the hood portion 11*a* of the male housing 11 is pushed into the hood portion 22 of the female housing 20, the distal end 13*a* of the release rib portion 13 in the male housing 11 abuts against the temporary locking projection 36*a* of the temporary locking arm portion 36 of the lever 30. Immediately before this abutment, the cam boss 12 of the male housing 11 enters the cam groove 35 of the lever 30.

Figure 9:
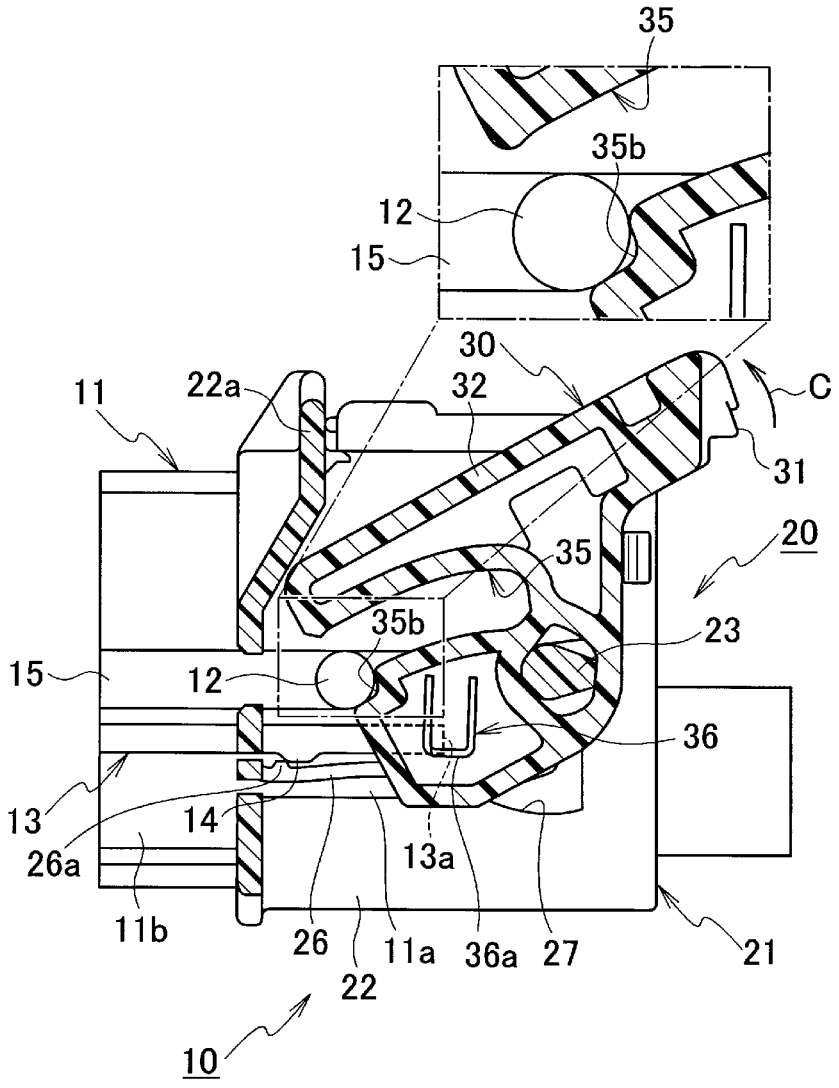
FIG. 9 is a sectional view taken along the line B-B in FIG. 6, illustrating the state after the male housing and the female housing are temporarily set.

Thereafter, as illustrated in FIG. 9, the cam boss 12 of the male housing 11 abuts against the boss receiving portion 35*b* of the cam groove 35 of the lever 30. As a result, even if the hood portion 11*a* of the male housing 11 is pushed further into the hood portion 22 of the female housing 20, the rotation of the operating portion 31 of the lever 30 in a direction of an arrow C is prevented (force vector is prevented from tilting when food portion 11*a* is pushed further into food portion 22). Consequently, the position of the lever 30 when the male housing 11 and the female housing 20 are temporarily set is restricted. Since the boss receiving portion 35*b* that receives the cam boss 12 of the male housing 11 is formed in the cam groove 35 of the lever 30 as described above, it is possible to prevent the lever 30 from rotating in the direction of the arrow C when the male housing 11 and the female housing 20 are temporarily set. Further, before the operating portion 31 of the lever 30 is operated, it is possible to reliably prevent electrical conduction between terminals of the male housing 11 and the female housing 20 in a state where the male housing 11 and the female housing 20 are temporarily set.

In addition, as illustrated in FIG. 9, when the cam boss 12 of the male housing 11 abuts against the boss receiving portion 35*b* of the cam groove 35 of the lever 30, the distal end 13*a* of the release rib portion 13 of the male housing 11 abuts against the temporary locking arm portion 36 of the lever 30 and pushes the temporary locking arm portion 36 upward. As a result, the temporary locking state of the cutaway portion 25 of the female housing 20 and the temporary locking projection 36*a* of the temporary locking arm portion 36 of the lever 30 starts to be released. Since the cam boss 12 of the male housing 11 is received by the boss receiving portion 35*b* of the cam groove 35 of the lever 30 as described above, the same structure makes it possible to temporarily set the male housing 11 and the female housing 20, and release the temporary locking state of the temporary locking arm portion 36 of the lever 30.

When the operating portion 31 of the lever 30 is rotated, the cam groove 35 of the arm portion 32 of the lever 30 engages with the cam boss 12 of the male housing 11 and thus the male housing 11 is made to move toward the female housing 20, so that the male housing 11 and the female housing 20 are fitted to each other. When the lever 30 is completely rotated, the locking projection 33 on the lower side of the operating portion 31 of the lever 30 is locked to the receiving portion 24*b* of the locking arm portion 24 in the female housing 20, which brings about the rotation restricting state where the rotation of the lever 30 is restricted.

While the present embodiment has been described above, the present embodiment is not limited thereto, and various modifications can be made within the scope of the gist of the present embodiment.

That is, according to the embodiment described above, the cutaway portion of the female housing functioning as a temporarily locked portion and the temporary locking projection of the temporary locking arm portion of the lever functioning as a temporary locking portion are temporarily locked to each other, however, the temporarily locked portion may be a recess, a protrusion, or the like besides the cutaway portion.

Next, a comparative example will be described. A lever-type connector 1 according to the comparative example includes a housing 2 having a fitting cylindrical portion 2*a* that is fitted into and removed from a hood portion 7*a* of a mating housing 7. In addition, the lever-type connector 1 includes a lever 4. The lever 4 is rotatably supported, via bearings 5, by support shafts 3 on both sides of the fitting cylindrical portion 2*a* of the housing 2, and has a cam groove 6 that engages with a cam follower 8 arranged in the hood portion 7*a* of the mating housing 7. By rotating an operating portion 4*a*, the cam groove 6 is engaged with the cam follower 8 and thus the housings 2 and 7 are fitted to each other.

The shaft center of the cam follower 8 in the mating housing 7, the cam follower 8 being engaged with the cam groove 6 of the lever 4, is shifted in position toward the operating portion 4*a*, which is upward of the shaft center of the bearing 5 of the lever 4 in a vertical direction (direction orthogonal to fitting direction of housing 2 and mating housing 7). For this reason, when the housings 2 and 7 are properly fitted, a terminal end portion 6*a* of the cam groove 6 that receives the cam follower 8 is located closer to the operating portion 4*a* than the bearing 5. Compared to a case where the terminal end portion 6*a* and the bearing 5 are located at the same height, the amount that the cam groove 6 extends to the side of the bearing 5 opposite to the side of the bearing 5 closer to the operating portion 4*a* (lower side) can be reduced, and thus it is possible to prevent the lever 4 from becoming large in the vertical direction.

However, in the lever-type connector 1 according to the comparative example, the cam follower 8 of the mating housing 7 abuts against a gentle slope of the cam groove 6 of the lever 4. For this reason, when the mating housing 7 is pushed further into the housing 2 from a temporarily set state of the housings 2 and 7, the lever 4 may rotate, and a female terminal 2A of the housing 2 and a male terminal 9 of the mating housing 7 may be fitted into a position where these terminals 2A and 9 can be electrically conducted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lever-type connector comprising:

a mating housing having a cam boss;

a housing that is fitted into and removed from the mating housing; and a lever that is rotatably supported by the housing via a support shaft, has a cam groove engaging with the cam boss, and is rotated from a temporary locking position to cause the cam groove to engage with the cam boss, thus moving the mating housing toward the housing and fitting the mating housing and the housing to each other, wherein the lever includes a temporary locking arm portion that has a temporary locking portion and is elastically deformable, the housing includes a temporarily locked portion that is temporarily locked to and unlocked from the temporary locking portion of the temporary locking arm portion, the mating housing includes a release rib portion that releases a temporary locking state of the temporary locking portion of the temporary locking arm portion and the temporarily locked portion of the housing, and the cam groove of the lever includes a boss receiving portion that receives the cam boss when the temporary locking state of the temporary locking portion of the temporary locking arm portion and the temporarily locked portion of the housing is released, wherein, of the lever, the temporary locking arm portion is arranged more radially inwards towards the support shaft than is the boss receiving portion, and wherein the housing includes a temporary set arm portion that prevents the mating housing from being removed from the housing, the mating housing and the housing being in a temporary set state when a temporary locking state of the temporary locking portion of the temporary locking arm portion of the lever and the temporarily locked portion of the housing is released.

2. The lever-type connector according to claim 1, wherein a projecting temporary set beak portion is formed on a lower surface of the release rib portion, a distal end of the temporary set arm portion includes a projection that slides along the lower surface of the release rib portion, and the temporary locking state of the temporary locking portion of the temporary locking arm portion of the lever and the temporarily locked portion of the housing is released at a position where the projection is across the temporary set beak portion from the lower surface of the release rib portion.

3. The lever-type connector according to claim 1, wherein a projecting temporary set beak portion is formed on a lower surface of the release rib portion.

4. A lever-type connector comprising:

a mating housing having a cam boss;

a housing that is fitted into and removed from the mating housing; and a lever that is rotatably supported by the housing via a support shaft, has a cam groove engaging with the cam boss, and is rotated from a temporary locking position to cause the cam groove to engage with the cam boss, thus moving the mating housing toward the housing and fitting the mating housing and the housing to each other, wherein the lever includes a temporary locking arm portion that has a temporary locking portion and is elastically deformable, the housing includes a temporarily locked portion that is temporarily locked to and unlocked from the temporary locking portion of the temporary locking arm portion, the mating housing includes a release rib portion that releases a temporary locking state of the temporary locking portion of the temporary locking arm portion and the temporarily locked portion of the housing, the cam groove of the lever includes a boss receiving portion that receives the cam boss when the temporary locking state of the temporary locking portion of the temporary locking arm portion and the temporarily locked portion of the housing is released, a projecting temporary set beak portion is formed on a lower surface of the release rib portion, the housing includes a temporary set arm portion that prevents the mating housing from being removed from the housing, the mating housing and the housing being in a temporary set state when a temporary locking state of the temporary locking portion of the temporary locking arm portion of the lever and the temporarily locked portion of the housing is released, a distal end of the temporary set arm portion includes a projection that slides along the lower surface of the release rib portion, and the temporary locking state of the temporary locking portion of the temporary locking arm portion of the lever and the temporarily locked portion of the housing is released at a position where the projection is across the temporary set beak portion from the lower surface of the release rib portion.

* * * * *